US010822671B2

(12) United States Patent
Lee et al.

(10) Patent No.: US 10,822,671 B2
(45) **Date of Patent: *Nov. 3, 2020**

(54) HIGH-STRENGTH STEEL HAVING SUPERIOR BRITTLE CRACK ARRESTABILITY, AND PRODUCTION METHOD THEREFOR

(71) Applicant: POSCO, Pohang-si (KR)

(72) Inventors: Hak-Cheol Lee, Pohang-si (KR); Sung-Ho Jang, Pohang-si (KR)

(73) Assignee: POSCO, Pohang-si (KR)

( * ) Notice: Subject to any disclaimer, the term of this patent is extended or adjusted under 35 U.S.C. 154(b) by 123 days.

This patent is subject to a terminal disclaimer.

(21) Appl. No.: 15/535,618

(22) PCT Filed: Dec. 21, 2015

(86) PCT No.: PCT/KR2015/014049
§ 371 (c)(1),
(2) Date: Jun. 13, 2017

(87) PCT Pub. No.: WO2016/105059
PCT Pub. Date: Jun. 30, 2016

(65) Prior Publication Data

US 2017/0335424 A1 Nov. 23, 2017

(30) Foreign Application Priority Data

Dec. 24, 2014 (KR) ..... 10-2014-0189133

(51) Int. Cl.
*C22C 38/08* (2006.01)
*C22C 38/12* (2006.01)
(Continued)

(52) U.S. Cl.
CPC ..... *C21D 9/46* (2013.01); *C21D 6/001* (2013.01); *C21D 6/005* (2013.01); *C21D 6/008* (2013.01);
(Continued)

(58) Field of Classification Search
CPC ..... C22C 38/02; C22C 38/04; C22C 38/08; C22C 38/12; C22C 38/14; C22C 38/16;
(Continued)

(56) References Cited

U.S. PATENT DOCUMENTS 7,914,629 B2 3/2011 Nakashima et al.
8,702,880 B2 4/2014 Cho et al.
(Continued)

FOREIGN PATENT DOCUMENTS

CN 101622370 1/2010
CN 101868560 10/2010
(Continued)

OTHER PUBLICATIONS

Demeri, Mahmoud Y., "Steel Fundamentals," Advanced High-Strength Steels—Science, Technology, and Applications, ASM International, 2013, pp. 23-58. (Year: 2013).*
(Continued)

*Primary Examiner* — Vanessa T. Luk
(74) *Attorney, Agent, or Firm* — Cantor Colburn LLP

(57) ABSTRACT

Provided are high-strength steel having superior brittle crack arrestability and a production method therefor. The structural ultra-thick steel comprises 0.05-0.1 wt % of C, 0.9-1.5 wt % of Mn, 0.8-1.5 wt % of Ni, 0.005-0.1 wt % of Nb, 0.005-0.1 wt % of Ti, 0.1-0.6 wt % of Cu, 0.1-0.4 wt % of Si, at most 100 ppm of P, and at most 40 ppm of S with the remainder being Fe and other inevitable impurities, has microstructures including one structure selected from the group consisting of a single-phase structure of ferrite, a
(Continued)

single-phase structure of bainite, a complex-phase structure of ferrite and bainite, a complex-phase structure of ferrite and pearlite, and a complex-phase structure of ferrite, bainite, and pearlite, and has a thickness of at least 50 mm. The high-strength steel has high yield strength and superior brittle crack arrestability.

6 Claims, 1 Drawing Sheet

(51) Int. Cl.

| | |
|---|---|
| ***C22C 38/14*** | (2006.01) |
| ***C22C 38/16*** | (2006.01) |
| ***C21D 9/46*** | (2006.01) |
| ***C22C 38/04*** | (2006.01) |
| ***C21D 6/00*** | (2006.01) |
| ***C21D 8/02*** | (2006.01) |
| ***C22C 38/00*** | (2006.01) |
| ***C22C 38/02*** | (2006.01) |

(52) U.S. Cl.
CPC ..... *C21D 8/0205* (2013.01); *C21D 8/0226* (2013.01); *C21D 8/0247* (2013.01); *C22C 38/002* (2013.01); *C22C 38/02* (2013.01); *C22C 38/04* (2013.01); *C22C 38/08* (2013.01); *C22C 38/12* (2013.01); *C22C 38/14* (2013.01); *C22C 38/16* (2013.01); *C21D 8/0263* (2013.01); *C21D 2211/002* (2013.01); *C21D 2211/005* (2013.01); *C21D 2211/009* (2013.01)

(58) Field of Classification Search
CPC ..... C21D 2211/002; C21D 2211/005; C21D 2211/009
See application file for complete search history.

(56) References Cited

U.S. PATENT DOCUMENTS

| | | | | |
|---|---|---|---|---|
| 9,255,305 | B2 | 2/2016 | Kim et al. | |
| 2009/0092515 | A1* | 4/2009 | Nakashima | C21D 8/02 420/92 |
| 2013/0292011 | A1* | 11/2013 | Kim | C21D 8/0205 148/654 |
| 2017/0327922 | A1 | 11/2017 | Lee et al. | |

FOREIGN PATENT DOCUMENTS

| | | | | |
|---|---|---|---|---|
| CN | 101341269 | | 9/2011 | |
| CN | 102271861 | | 3/2013 | |
| CN | 103403204 | | 11/2013 | |
| EP | 2006407 | | 12/2008 | |
| EP | 2119803 | | 11/2009 | |
| EP | 2390047 | | 11/2011 | |
| EP | 2520683 | | 11/2012 | |
| EP | 2660346 | | 11/2013 | |
| EP | 3239332 | | 11/2017 | |
| JP | 04180521 | | 6/1992 | |
| JP | 08003636 | | 1/1996 | |
| JP | 08120338 | | 5/1996 | |
| JP | 11279684 | | 10/1999 | |
| JP | 3211046 | | 7/2001 | |
| JP | 2006265698 | | 10/2006 | |
| JP | 2007302993 | | 11/2007 | |
| JP | 2008169468 | | 7/2008 | |
| JP | 2008248382 | | 10/2008 | |
| JP | 5082667 | | 11/2012 | |
| JP | 2013221189 | | 10/2013 | |
| JP | 2013221190 | | 10/2013 | |
| JP | 2018503744 | | 2/2018 | |
| JP | 2018504523 | | 2/2018 | |
| KR | 20010002776 | | 1/2001 | |
| KR | 100723201 | | 5/2007 | |
| KR | 20090052950 | | 5/2009 | |
| KR | 20090071166 | | 7/2009 | |
| KR | 20140098900 | | 8/2014 | |
| KR | 101444646 | | 9/2014 | |
| KR | 20160078926 | | 7/2016 | |
| WO | 2009066863 | | 5/2009 | |
| WO | 2013099179 | | 7/2013 | |
| WO | 2013099318 | | 7/2013 | |
| WO | WO-2013099179 | A1 * | 7/2013 | C22C 38/002 |
| WO | 2013150687 | | 10/2013 | |

OTHER PUBLICATIONS

European Search Report—European Application No. 15873586.0, dated Oct. 10, 2017, citing EP 2 660 346, KR 100 723 201, JP 3 211046, EP 2 119 803, EP 2 006 407, EP 2 390 407 and JP H11 279684.

International Search Report—PCT/KR2015/014049 dated Apr. 7, 2016.

* cited by examiner

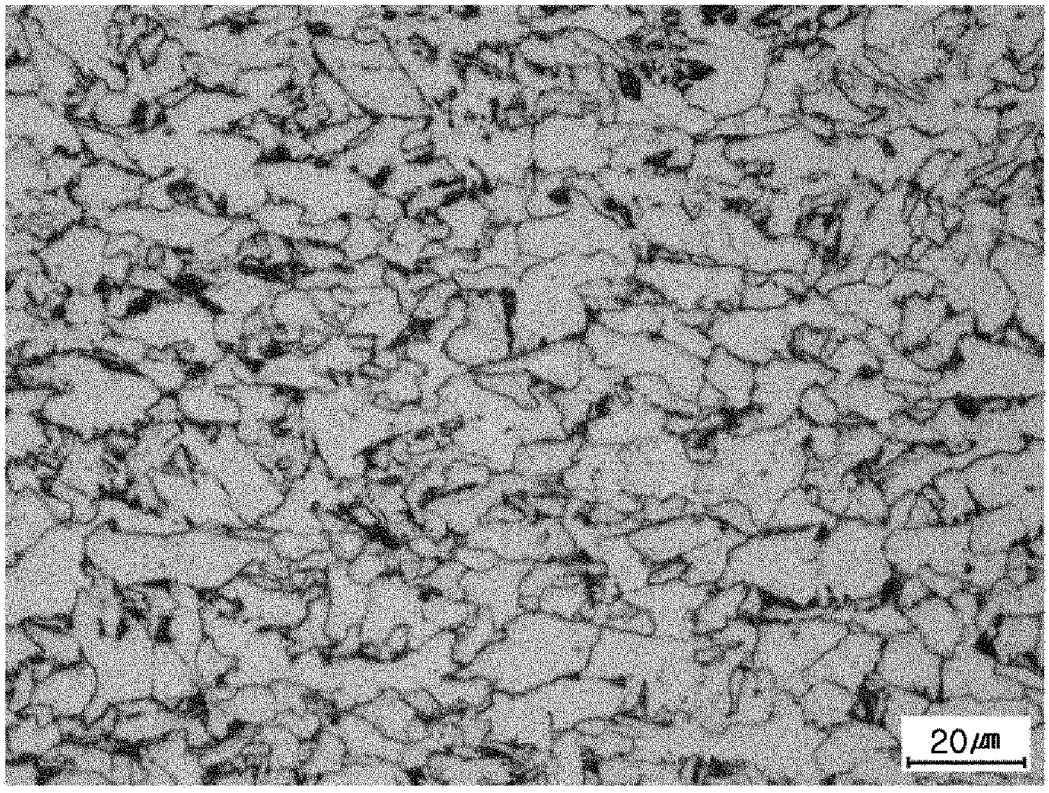
20μm

HIGH-STRENGTH STEEL HAVING SUPERIOR BRITTLE CRACK ARRESTABILITY, AND PRODUCTION METHOD THEREFOR

TECHNICAL FIELD

The present disclosure relates to a high-strength steel having excellent brittle crack arrestability, and a method of manufacturing the same.

BACKGROUND ART

In designing structures used in domestic and international shipbuilding, marine engineering, architecture and civil engineering fields, the development of extremely thick steel having high strength characteristics has been required.

When high-strength steel is used in designing structures, since such structures may be lightened, an economical benefit may be obtained; and since a thickness of a steel sheet may be reduced, ease of processing and welding operations may be secured simultaneously.

In general, in the case of high-strength steel, when an extremely thick steel plate is produced, since sufficient deformation may not be obtained due to a decrease in total reduction ratios, compared to thin materials, microstructures of extremely thick materials may coarsen. Thus, low-temperature properties relatively greatly affected by grain sizes may be deteriorated.

In detail, in the case of brittle crack arrestability indicating the stability of structures, a case in which a guaranteed level of brittle crack arrestability is required for application thereof to major structures such as ships or the like has increased. However, in the case in which microstructures are coarsened, brittle crack arrestability may be significantly lowered. Thus, it may be more difficult to improve brittle crack arrestability of extremely thick high-strength steel sheets.

On the other hand, in the case of high strength steel having a yield strength of 390 MPa or more, various techniques such as the application of surface cooling thereto during finish rolling to refine grains of surface layer portions, controlling grain sizes by bending stress during rolling, and the like have been introduced to improve brittle crack arrestability.

However, such techniques may be helpful in refining the structures of surface layer portions, but a problem of degradation of impact toughness due to coarsening of structures other than the surface layer portions may not be solved. Thus, the techniques as above may not be fundamental countermeasures for brittle crack arrestability.

In addition, since the technique itself is expected to cause deteriorations in productivity in the case of the application thereof to general production systems, there may be difficulties in commercial applications thereof.

DISCLOSURE

Technical Problem

An aspect of the present disclosure is to provide a high strength steel having excellent brittle crack arrestability.

Another aspect of the present disclosure is to provide a method of manufacturing a high strength steel having excellent brittle crack arrestability.

Technical Solution

According to an aspect of the present disclosure, a high-strength steel having excellent brittle crack arrestability includes 0.05 wt % to 0.1 wt % of carbon (C), 0.9 wt % to 1.5 wt % of manganese (Mn), 0.8 wt % to 1.5 wt % of nickel (Ni), 0.005 wt % to 0.1 wt % of niobium (Nb), 0.005 wt % to 0.1 wt % of titanium (Ti), 0.1 wt % to 0.6 wt % of copper (Cu), 0.1 wt % to 0.4 wt % of silicon (Si), 100 ppm or less of phosphorus (P), 40 ppm or less of sulfur (S), and the remainder being iron (Fe) and other inevitably contained impurities, the high-strength steel having a microstructure including one structure selected from the group consisting of a single-phase structure of ferrite, a single-phase structure of bainite, a complex structure of ferrite and bainite, a complex structure of ferrite and pearlite, and a complex structure of ferrite, bainite and pearlite, and having a thickness of 50 mm or more.

The contents of Cu and Ni may be set such that a weight ratio of Cu/Ni is 0.6 or less, in detail, 0.5 or less.

In the high-strength steel, a grain size of a crystal grain having a high angle boundary, in which a difference in crystal orientations measured in a region from a surface layer portion to a ¼ thickness point thereof in a thickness direction using an EBSD method is 15 degrees or more, may be 15 μm (micrometers) or less.

In the high-strength steel, an area ratio of a (100) plane forming an angle of less than 15 degrees with respect to a plane thereof parallel to a rolling direction in a region from a surface layer portion to a ¼ thickness point thereof in a thickness direction may be 30% or more.

The high-strength steel may have a yield strength of 390 MPa or more.

According to another aspect of the present disclosure, a method of manufacturing a high-strength steel having excellent brittle crack arrestability includes reheating a slab to a temperature between 950° C. and 1100° C. and then rough-rolling the slab at a temperature between 1100° C. and 900° C., the slab including 0.05 wt % to 0.1 wt % of carbon (C), 0.9 wt % to 1.5 wt % of manganese (Mn), 0.8 wt % to 1.5 wt % of nickel (Ni), 0.005 wt % to 0.1 wt % of niobium (Nb), 0.005 wt % to 0.1 wt % of titanium (Ti), 0.1 wt % to 0.6 wt % of copper (Cu), 0.1 wt % to 0.4 wt % of silicon (Si), 100 ppm or less of phosphorus (P), 40 ppm or less of sulfur (S), and the remainder being iron (Fe) and other inevitably contained impurities; obtaining a steel sheet having a thickness of 50 mm or more by finish-rolling a rough-rolled bar at a temperature between $Ar_3$+30° C. and $Ar_3$−30° C.; and cooling the steel sheet to a temperature of 700° C. or less.

The contents of Cu and Ni may be set such that a weight ratio of Cu/Ni is 0.6 or less, in detail, 0.5 or less.

In the rough-rolling, a reduction ratio per pass with respect to the last three passes may be 5% or more, and a total cumulative reduction ratio may be 40% or more.

A grain size of a ¼t point, where t refers to a thickness of a steel sheet, of a bar after the rough-rolling and before the finish-rolling may be may be 150 μm or less, in detail, 100 μm or less, in further detail, 80 μm or less.

A reduction ratio during the finish-rolling may be set such that a ratio of a slab thickness (mm)/a steel sheet thickness (mm) after the finish-rolling is 3.5 or above, in detail, 3.8 or above.

The cooling of the steel sheet may be performed at a cooling rate of a central portion of the steel sheet of 2° C./s or higher.

The cooling of the steel sheet may be performed at an average cooling rate from 3° C./s to 300° C./s.

In addition, the solution of the above-mentioned problems does not list all possible features in the present disclosure.

The various features in the present disclosure and the advantages and effects thereof will be more fully understood by referring to the following specific embodiments.

Advantageous Effects

According to an exemplary embodiment in the present disclosure, a high strength steel having a relatively high yield strength and excellent brittle crack arrestability may be obtained.

DESCRIPTION OF DRAWINGS

FIG. 1 is an image of a central portion of Inventive steel 1 in a thickness direction, captured using an optical microscope.

BEST MODE

The inventors of the present disclosure conducted research and experimentation into improving the yield strength and brittle crack arrestability of a thick steel having a thickness of 50 mm or more, and the present disclosure was proposed based on the research results.

According to an exemplary embodiment in the present disclosure, the yield strength and brittle crack arrestability of a relatively thick steel may be further improved by controlling a steel composition, a structure, a texture and manufacturing conditions of steel.

A main concept in the present disclosure is as follows.

1) A steel composition may be appropriately controlled to obtain improved strength of steel through solid solution strengthening. In detail, manganese (Mn), nickel (Ni), copper (Cu), and silicon (Si) may be used in appropriate amounts to obtain solid solution strengthening.

2) The steel composition may be appropriately controlled to improve steel strength via improved hardenability. In detail, the contents of Mn, Ni and Cu may be appropriately applied along with a carbon content to improve the hardenability.

By improving the hardenability as described above, a fine structure in a central portion of a thick steel having a thickness of 50 mm or more may also be secured even at a relatively slow cooling rate.

3) In detail, a structure of steel may be refined to improve steel strength and brittle crack arrestability. In detail, a structure of a ¼ point of a steel sheet from a surface layer portion of the steel sheet in a thickness direction may be refined.

By refining the structure of the steel as described above, the strength of the steel may be improved via strengthening by grain refinement, and the occurrence and propagation of cracks may be significantly reduced, thereby improving brittle crack arrestability.

4) In detail, the texture of the steel may be controlled to improve brittle crack arrestability.

By considering that cracking propagates in a width direction of a steel, that is, in a direction perpendicular to a rolling direction and that a brittle fracture surface of a body-centered cubic structure (BCC) is a (100) plane, an area ratio of the (100) plane forming an angle of less than 15 degrees with respect to a plane thereof parallel to a rolling direction may be set to be significantly increased.

In detail, the texture of the steel in a region of a steel plate from a surface layer portion of the steel plate to a ¼ point thereof in a thickness direction may be controlled.

The (100) plane forming an angle of less than 15 degrees with respect to the plane of the steel plate parallel to the rolling direction may serve to block the propagation of cracks.

By controlling the texture of the steel as described above, the propagation of cracks may be blocked even in the case in which cracking occurs, thereby improving brittle crack arrestability.

5) In detail, rough rolling conditions may be controlled to further refine the structure of the steel.

In further detail, a fine structure may be secured by controlling reduction conditions during rough rolling.

6) Finish rolling conditions may be controlled to further refine the structure of the steel. In detail, by controlling a finish rolling temperature and reduction conditions, relatively fine ferrite may be formed at grain boundaries and inside crystal grains due to strain induced transformation during finish rolling, thereby securing a fine structure even in a central portion of the steel.

Hereinafter, a high strength steel having excellent brittle crack arrestability according to an exemplary embodiment in the present disclosure will be described in detail.

A high-strength steel having excellent brittle arrestability according to an exemplary embodiment may include 0.05 wt % to 0.1 wt % of carbon (C), 0.9 wt % to 1.5 wt % of manganese (Mn), 0.8 wt % to 1.5 wt % of nickel (Ni), 0.005 wt % to 0.1 wt % of niobium (Nb), 0.005 wt % to 0.1 wt % of titanium (Ti), 0.1 wt % to 0.6 wt % of copper (Cu), 0.1 wt % to 0.4 wt % of silicon (Si), 100 ppm or less of phosphorus (P), 40 ppm or less of sulfur (S), and the remainder being iron (Fe) and other inevitably contained impurities; and may have a microstructure including one structure selected from the group consisting of a single-phase structure of ferrite, a single-phase structure of bainite, a complex structure of ferrite and bainite, a complex structure of ferrite and pearlite, and a complex structure of ferrite, bainite and pearlite.

Hereinafter, a steel component and a steel component range according to an exemplary embodiment will be described.

C (Carbon): 0.05% to 0.10% (Hereinafter, the Contents of Respective Components Refer to Weight %)

Since C may be a relatively important element in securing basic strength, C may be required to be contained in steel within an appropriate range. In order to obtain such an additive effect, C may be added in an amount of 0.05% or more.

However, if a content of C exceeds 0.10%, low temperature toughness of steel may be lowered due to the formation of a relatively large amount of martensite-austenite constituent (MA), relatively high strength of the ferrite itself, a relatively large amount of low-temperature transformation phases, and the like. Thus, the content of C may be limited to 0.05% to 0.10%, in detail, 0.059% to 0.091%, in further detail, 0.065% to 0.085%.

Mn (Manganese): 0.9% to 1.5%

Mn may be a useful element in improving steel strength by solid solution strengthening and in improving hardenability of steel to form a low temperature transformation phase. In order to obtain such effect, Mn may be added in an amount of 0.9% or more.

However, if the content of Mn exceeds 1.5%, the formation of upper bainite and martensite may be promoted due to an excessive increase in hardenability, and a segregation in a central portion of steel may occur to form a coarse low-temperature transformation phase, thereby lowering impact toughness and brittle crack arrestability.

Thus, the content of Mn may be limited to 0.9% to 1.5%, in detail, 0.95% to 1.26%, in further detail, 1.15% to 1.30%.

Ni (Nickel): 0.8% to 1.5%

Ni may be an important element for facilitating dislocation cross slip at a relatively low temperature to improve impact toughness and for improving hardenability to improve steel strength. In order to obtain such an effect, Ni may be added in an amount of 0.8% or more. However, if Ni is added in an amount of 1.5% or more, the hardenability may be excessively increased to generate a low-temperature transformation phase and thus reduce steel toughness, and manufacturing costs may also be increased. Thus, an upper limit of the Ni content may be limited to 1.5%.

In detail, the content of Ni may be limited to 0.94% to 1.38%, and in further detail, may be limited to 1.01% to 1.35%.

Nb (Niobium): 0.005% to 0.1%

Nb precipitates in the form of NbC or NbCN to improve the strength of a base material.

In addition, Nb dissolved at the time of reheating to a relatively high temperature may be relatively finely precipitated in the form of NbC at the time of rolling, thereby suppressing recrystallization of austenite to refine the structure.

Thus, Nb may be added in an amount of 0.005% or more, but if Nb is added excessively, a possibility of causing a brittle crack at an edge of steel may be present, and thus an upper limit of the Nb content may be limited to 0.1%.

In detail, the content of Nb may be limited to 0.016% to 0.034%, and in more detail, may be limited to 0.018% to 0.024%.

Ti (Titanium): 0.005% to 0.1%

Ti is a component precipitated as TiN at the time of reheating to suppress the growth of crystal grains of a base material and a weld heat affected portion to thus significantly improve low-temperature toughness. In order to obtain such an effect, Ti may be added in an amount of 0.005% or more.

However, if the content of Ti exceeds 0.1%, since a continuous casting nozzle may be clogged, or low temperature toughness may be reduced by crystallization in a central portion, the content of Ti may be limited to 0.005% to 0.1%.

In detail, the content of Ti may be limited to 0.007% to 0.023%, in further detail, 0.011% to 0.018%.

P (Phosphorus): 100 ppm or Less, S (Sulfur): 40 ppm or Less

P and S are elements causing brittleness at grain boundaries or the formation of coarse inclusions to induce brittleness. In order to improve brittle crack arrestability, the content of P may be limited to 100 ppm or less, and the content of S may be limited to 40 ppm or less.

Si (Silicon): 0.1% to 0.4%

Si improves steel strength and has a relatively high deoxidizing effect. Thus, since Si may be an essential element for the production of clean steel, Si may be added in an amount of 0.1% or more. However, if Si is added in a relatively large amount, a coarse martensite-austenite constituent (MA) may be formed to lower brittle crack arrestability. Thus, an upper limit of Si content may be limited to 0.4%.

In detail, the content of Si may be limited to 0.21% to 0.33%, and in further detail, may be limited to 0.25% to 0.3%.

Cu (Copper): 0.1% to 0.6%

Cu may be an important element in improving the hardenability and providing a solid solution strengthening to improve the strength of steel, and may also be a main element for increasing yield strength through the formation of upsilon Cu precipitate during tempering application. Thus, Cu may be added in an amount of 0.1% or more. However, if a relatively large amount of Cu is added, since cracking of a slab may occur due to hot shortness during a steelmaking process, an upper limit of the Cu content may be limited to 0.6%.

In detail, the content of Cu may be limited to 0.13% to 0.55%, in further detail, 0.18% to 0.3%.

The contents of Cu and Ni may be set such that a weight ratio of Cu/Ni may be 0.6 or less, in detail, 0.5% or less.

As described above, in the case in which the weight ratio of Cu/Ni is set, a surface quality may be further improved.

According to an exemplary embodiment, iron (Fe) may be provided as a remaining component thereof.

On the other hand, in an ordinary manufacturing process, non-intended impurities may be inevitably present, from a raw material or a surrounding environment, which may not be excluded.

The impurities may be known to those skilled in the art, and thus, may not be particularly described in this specification.

The steel according to an exemplary embodiment may have a microstructure including a single structure selected from the group consisting of a single phase structure of ferrite, a single phase structure of bainite, a complex structure of ferrite and bainite, a complex structure of ferrite and pearlite, and a complex structure of ferrite, bainite and pearlite.

As the ferrite, polygonal ferrite or acicular ferrite may be used, and as the bainite, granular bainite may be used.

For example, as the contents of Mn and Ni increase, a fraction of acicular ferrite and granular bainite increases, and the strength of steel may also increase accordingly.

For example, when the microstructure of the steel is a complex structure including pearlite, a fraction of pearlite may be limited to 20 volume % or less.

In the high-strength steel, a grain size of a crystal grain having a high angle boundary, in which a difference in crystal orientations measured in a region from a surface layer portion to a ¼ thickness point thereof in a thickness direction using an EBSD method is 15 degrees or more, may be 15 μm (micrometers) or less.

As described above, by refining grains having a high angle boundary, in which a difference in crystal orientations measured in a region from the surface layer portion of the steel plate to the ¼ thickness point thereof in a thickness direction using an EBSD method is 15 degrees or more, such that the grain size may be 15 μm (micrometers) or less, the strength of the steel may be improved through strengthening by grain refinement, and further, the occurrence and propagation of cracks may be significantly reduced, thereby improving brittle crack arrestability.

In detail, in the case of the steel, an area ratio of a (100) plane forming an angle of less than 15 degrees with respect to a plane thereof parallel to a rolling direction in a region from the surface layer portion of a steel plate to the ¼ point thereof in the thickness direction may be 30% or more.

A main reason for controlling a texture as described above is as follows.

Cracks may propagate in a width direction of the steel plate, that is, in a direction perpendicular to the rolling direction, and a brittle fracture surface of a body-centered cubic structure (BCC) may be the (100) plane.

Thus, in an exemplary embodiment of the present disclosure, an area ratio of the (100) plane forming an angle of less than 15 degrees with respect to the plane of the steel plate parallel to the rolling direction may be a maximum area ratio.

In detail, the texture of the steel in a region of a steel plate from a surface layer portion of the steel plate to a ¼ thickness point thereof in a thickness direction may be controlled.

The (100) plane forming an angle of less than 15 degrees with respect to the plane of the steel plate parallel to the rolling direction may serve to block propagation of cracks.

As described above, as the area ratio of the (100) plane forming an angle of less than 15 degrees with respect to the plane parallel to the rolling direction in the region from the surface layer portion to the ¼ thickness point of a steel plate in the thickness direction is controlled to 30% or more, even in the case in which cracking occurs, the propagation of cracks may be blocked, and brittle crack arrestability may be improved.

In detail, the steel may have a yield strength of 390 MPa or more.

The steel may have a thickness of 50 mm or more, and in detail, may have 50 mm to 100 mm, in further detail, 80 mm to 100 mm.

Hereinafter, a method of manufacturing a high strength steel having excellent brittle crack arrestability according to another exemplary embodiment in the present disclosure will be described in detail.

A method of manufacturing a high-strength steel having excellent brittle crack arrestability according to another exemplary embodiment may include reheating a slab to a temperature between 950° C. and 1100° C. and then rough-rolling the slab at a temperature between 1100° C. and 900° C., the slab including 0.05 wt % to 0.1 wt % of carbon (C), 0.9 wt % to 1.5 wt % of manganese (Mn), 0.8 wt % to 1.5 wt % of nickel (Ni), 0.005 wt % to 0.1 wt % of niobium (Nb), 0.005 wt % to 0.1 wt % of titanium (Ti), 0.1 wt % to 0.6 wt % of copper (Cu), 0.1 wt % to 0.4 wt % of silicon (Si), 100 ppm or less of phosphorus (P), 40 ppm or less of sulfur (S), and the remainder being iron (Fe) and other inevitably contained impurities; obtaining a steel sheet by finish-rolling a rough-rolled bar at a temperature between $Ar_3$+30° C. and $Ar_3$−30° C.; and cooling the steel sheet to a temperature of 700° C. or less.

Reheating of Slab

A slab may be reheated before rough rolling.

A slab reheating temperature may be 950° C. or higher, to dissolve carbonitride of Ti and/or Nb formed during casting. Further, in order to sufficiently dissolve the carbonitride of Ti and/or Nb, the slab reheating temperature may be 1000° C. or higher. However, if the reheating is performed at an excessively high temperature, since austenite may be coarsened, an upper limit of the reheating temperature may be 1100° C.

Rough Rolling

The reheated slab may be rough-rolled.

A rough rolling temperature may be set to be a temperature (Tnr) at which recrystallization of austenite is stopped, or more. An effect of reducing a size of austenite and breaking a cast structure such as dendrites or the like formed during casting by rolling may also be obtained. In order to obtain such an effect, a rough rolling temperature may be limited to a temperature between 1100° C. to 900° C.

In the present disclosure, in order to refine the structure of the central portion during rough rolling, a reduction ratio per pass with respect to the last three passes during rough rolling may be 5% or more, and a total cumulative reduction ratio may be 40% or more.

In the case of a recrystalized structure formed due to initial rolling during rough rolling, the growth of crystal grains may occur at a relatively high temperature, while when the last three passes are performed, a grain growth rate may be decreased due to air cooling of a bar during rolling standing by. Thus, a reduction ratio of the last three passes during rough rolling may relatively significantly affect a grain size of an ultimately obtained microstructure.

In addition, for example, if the reduction ratio per pass of the rough rolling is lowered, since sufficient deformation may not be transferred to a central portion of a steel plate, toughness degradation may occur due to center coarsening. Thus, the reduction ratio per pass of the last three passes may be limited to 5% or more.

On the other hand, in order to refine the structure of the central portion of the steel plate, a cumulative rolling reduction ratio at the time of rough rolling may be set to be 40% or more.

Finish Rolling

A roughly rolled bar may be subjected to finish rolling at $Ar_3$ (ferrite transformation start temperature)+30° C. to $Ar_3$−30° C. to obtain a steel sheet.

Thus, a further refined microstructure may be obtained. For example, when the rolling is performed at a temperature immediately above or below the Ar3 temperature, relatively fine ferrite may be formed at grain boundaries and inside crystal grains due to strain induced transformation, thereby providing an effect of reducing a grain unit.

Further, in order to obtain effective strain induced transformation, a cumulative reduction ratio at the time of finish rolling may be maintained at 40% or higher, and a reduction ratio per pass excluding last hot rolling for shape control may be maintained at 8% or more.

By performing the finish rolling under the conditions proposed in an exemplary embodiment of the present disclosure, a grain size of a crystal grain having a high angle boundary, in which a difference in crystal orientations measured in a region from a surface layer portion of a steel plate to a ¼ thickness point thereof in a thickness direction using an EBSD method is 15 degrees or more, may be 15 μm (micrometers) or less, and thus, a microstructure having the grain size as described above may be obtained.

If a finish rolling temperature is lowered to $Ar_3$−30° C. or below, coarse ferrite may be formed before rolling, and the steel may thus be lengthwise elongated during rolling, to lower impact toughness. If the finish rolling is performed at $Ar_3$+30° C. or higher, fine grains may not be effectively obtained. Thus, finish rolling may be performed within a finish rolling temperature range from $Ar_3$+30° C. to $Ar_3$−30° C.

A grain size of a ¼t point, where t refers to a thickness of a steel sheet, of a bar after the rough rolling and before the finish rolling may be set to be 150 μm or less, in detail 100 μm or less, in further detail, 80 μm or less.

The grain size of the ¼t point of the bar after the rough rolling and before the finish rolling may be controlled according to rough rolling conditions and the like.

As described above, when controlling the grain size of the ¼t point of the bar after the rough rolling and before the finish rolling, a microstructure ultimately obtained according to refining of austenite grains may be refined, thereby improving low temperature impact toughness.

A reduction ratio during the finish-rolling may be set such that a ratio of a slab thickness (mm)/a steel sheet thickness (mm) after finish-rolling may be 3.5 or above, in detail, 3.8 or above.

As described above, in the case of controlling the reduction ratio, as the reduction amount in the rough rolling and the finish rolling is increased, a yield/tensile strength and low temperature toughness may be improved through an ultimately obtained refined microstructure. In addition, toughness of a central portion of a steel sheet may be improved through the reduced grain size in a central portion of the steel sheet in a thickness direction.

After the finish rolling, the steel sheet may have a thickness of 50 mm or more, and in detail, may have 50 mm to 100 mm, in further detail, 80 mm to 100 mm.

Cooling

After the finish rolling, the steel sheet may be cooled to 700° C. or less.

If a cooling end temperature exceeds 700° C., since the microstructure may not be properly formed, the yield strength may be 390 MPa or less.

The cooling of a central portion of the steel sheet may be performed at a cooling rate of 2° C./s or higher. If the cooling rate of the central portion of the steel sheet is less than 2° C./s, the microstructure may not be properly formed and the yield strength may be 390 Mpa or less.

In addition, the cooling of the steel sheet may be performed at an average cooling rate from 3° C./s to 300° C./s.

MODE FOR INVENTION

Hereinafter, an exemplary embodiment in the present disclosure will be described in further detail with reference to Embodiments.

It should be noted, however, that the following embodiments are intended to illustrate the present disclosure in more detail and not to limit the scope of the invention.

In other words, the scope of the invention is determined by the matters described in the claims and the matters reasonably deduced therefrom.

Embodiment 1

A steel slab having a thickness of 400 mm and a composition described in the following Table 1 was reheated to a temperature of 1040° C., and was then followed by rough rolling at a temperature of 1010° C. to prepare a bar. A cumulative reduction ratio during the rough rolling was set to be 50%.

A thickness of the rough-rolled bar was 180 mm, and a grain size of a ¼t point thereof after the rough rolling and before the finish rolling was 95 μm.

After the rough rolling was performed, finish rolling was performed at a temperature obtained by deducting an Ar3 temperature from a finish rolling temperature, shown in the following Table 2, to obtain a steel sheet having a thickness shown in Table 2. Then, the steel sheet was cooled to a temperature of 700° C. or less at a cooling rate of 4.2° C./sec.

With respect to the steel sheet produced as described above, a microstructure, a yield strength, an average grain size of the ¼t point in a thickness direction, an area ratio of a (100) plane forming an angle of less than 15 degrees with respect to a plane thereof parallel to a rolling direction in a region from a surface layer portion of a steel plate to a ¼ point thereof in the thickness direction, and a Kca value (a brittle crack arrestability coefficient) were measured. The measurement results are described in Table 2 below.

Kca values in Table 2 are values obtained by performing an ESSO test on the steel sheet.

TABLE 1

| | Steel Composition (Weight %) | | | | | | | | | |
|---|---|---|---|---|---|---|---|---|---|---|
| Steel Grade | C | Si | Mn | Ni | Cu | Ti | Nb | P (ppm) | S (ppm) | Cu/Ni weight % |
| Inventive Steel 1 | 0.063 | 0.32 | 1.12 | 0.99 | 0.36 | 0.019 | 0.022 | 68 | 15 | 0.36 |
| Inventive Steel 2 | 0.069 | 0.22 | 1.26 | 0.94 | 0.39 | 0.017 | 0.016 | 72 | 12 | 0.41 |
| Inventive Steel 3 | 0.072 | 0.29 | 0.95 | 1.16 | 0.45 | 0.021 | 0.013 | 56 | 13 | 0.39 |
| Inventive Steel 4 | 0.059 | 0.31 | 1.24 | 1.21 | 0.27 | 0.012 | 0.021 | 52 | 24 | 0.22 |
| Inventive Steel 5 | 0.081 | 0.21 | 1.11 | 1.03 | 0.41 | 0.023 | 0.034 | 63 | 26 | 0.40 |
| Inventive Steel 6 | 0.085 | 0.33 | 1.16 | 1.38 | 0.55 | 0.021 | 0.020 | 81 | 18 | 0.40 |
| Comparative Steel 1 | 0.066 | 0.21 | 1.12 | 0.85 | 0.37 | 0.016 | 0.025 | 77 | 17 | 0.44 |
| Comparative Steel 2 | 0.013 | 0.23 | 1.36 | 1.07 | 0.28 | 0.017 | 0.018 | 59 | 25 | 0.26 |
| Comparative Steel 3 | 0.059 | 0.61 | 1.25 | 1.18 | 0.53 | 0.019 | 0.025 | 51 | 12 | 0.45 |
| Comparative Steel 4 | 0.072 | 0.29 | 2.01 | 1.24 | 0.33 | 0.024 | 0.015 | 68 | 11 | 0.27 |
| Comparative Steel 5 | 0.068 | 0.32 | 1.18 | 2.08 | 0.29 | 0.021 | 0.019 | 71 | 26 | 0.14 |
| Comparative Steel 6 | 0.070 | 0.25 | 1.08 | 1.16 | 0.42 | 0.016 | 0.017 | 156 | 78 | 0.36 |

TABLE 2

| Steel Grade | Finish Rolling Temperature − (minus) $Ar_3$ temperature (° C.) | Product Thickness (mm) | *Microstructure Phase Fraction (%) | (001) texture | Yield Strength (Mpa) | ¼ t Average Grain Size (μm) | Kca ($N/mm^{1.5}$, @ −10° C.) |
|---|---|---|---|---|---|---|---|
| Inventive Steel 1 | −25 | 90 | PF + P (15%) | 35 | 407 | 13.1. | 9025 |
| Inventive Steel 2 | 15 | 85 | AF | 40 | 439 | 10.9 | 8856 |
| Inventive Steel 3 | 28 | 85 | AF + GB (30%) | 32 | 489 | 12.9 | 7958 |
| Inventive Steel 4 | 12 | 85 | AF + GB (22%) | 39 | 477 | 11.8 | 7725 |
| Inventive Steel 5 | 7 | 85 | AF + GB (35%) | 37 | 506 | 12.9 | 6855 |
| Inventive Steel 6 | −15 | 100 | PF + P (12%) | 31 | 403 | 13.4 | 7022 |
| Comparative Steel 1 | 65 | 85 | PF + P (16%) | 21 | 406 | 24.7 | 4365 |
| Comparative Steel 2 | 23 | 90 | UB | 12 | 566 | 32.9 | 3223 |
| Comparative Steel 3 | 12 | 80 | AF + UB (29%) | 26 | 501 | 19.4 | 4012 |
| Comparative Steel 4 | 10 | 90 | UB | 16 | 599 | 31.1 | 3854 |
| Comparative Steel 5 | −6 | 85 | GB, UB (33%) | 24 | 525 | 29.3 | 3968 |
| Comparative Steel 6 | −8 | 90 | AF + GB (28%) | 31 | 509 | 14.3 | 4562 |

*PF: Polygonal Ferrite, P: Pearlite, AF: Acicular Ferrite, GB: Granular Bainite, UB: Upper Bainite, Phase Fraction (%): Volume %

As indicated in Table 2, in the case of Comparative Steel 1, in which a temperature difference obtained by deducting an Ar3 temperature from a finish rolling temperature during finish rolling proposed in the present disclosure was controlled to 50° C. or higher, it can be seen that since a sufficient reduction was not applied, a grain size of the ¼t point was 24.7 μm, an area ratio of a (100) plane forming an angle of less than 15 degrees with respect to a plane of a steel plate parallel to a rolling direction in a region from a surface layer portion of the steel plate to a ¼ thickness point thereof in a thickness direction was 30% or less, and a Kca value measured at −10° C. did not exceed 6000 required in general steel for ship building.

In the case of Comparative Steel 2, in which a content of C has a value higher than an upper limit of a C content of an exemplary embodiment in the present disclosure, it can be seen that even when a grain size of austenite in a central portion thereof was refined through cooling during rough rolling, upper bainite was formed, and thus, a grain size of a microstructure ultimately obtained was 32.9 μm, an area ratio of a (100) plane forming an angle of less than 15 degrees with respect to a plane of a steel plate parallel to a rolling direction in a region from a surface layer portion of the steel plate to a ¼ thickness point thereof in a thickness direction was 30% or less, and further, a Kca value was 6000 or less at −10° C. due to having the upper bainite in which brittleness easily occurs as a base structure.

In the case of Comparative Steel 3, in which a content of Si has a value higher than an upper limit of a Si content of an exemplary embodiment in the present disclosure, it can be seen that even when a grain size of austenite in a central portion thereof was refined through cooling during rough rolling, upper bainite was partially formed in the central portion, and further, as a relatively large amount of Si was added, an MA structure was coarsely formed in a large amount, and thus, a Kca value also was a value of 6000 or less at −10° C.

In the case of Comparative Steel 4, in which a content of Mn has a value higher than an upper limit of a Mn content of an exemplary embodiment in the present disclosure, it can be seen that a microstructure of a base material was upper bainite due to having relatively high hardenability, and even when a grain size of austenite in a central portion thereof was refined through cooling during rough rolling, a grain size of a microstructure ultimately obtained was 31.1 μm, and an area ratio of a (100) plane forming an angle of less than 15 degrees with respect to a plane of a steel plate parallel to a rolling direction in a region from a surface layer portion of the steel plate to a ¼ thickness point thereof in a thickness direction was 30% or less, and thus, a Kca value was 6000 or less at −10° C.

In the case of Comparative Steel 5, in which a content of Ni has a value higher than an upper limit of a Ni content of an exemplary embodiment in the present disclosure, it can be seen that a microstructure of a base material was granular bainite and upper bainite due to having relatively high hardenability, and even when a grain size of austenite in a central portion thereof was refined through cooling during rough rolling, a grain size of a microstructure ultimately obtained was 29.3 μm, and thus, a Kca value was 6000 or less at −10° C.

In the case of Comparative Steel 6, in which contents of P and S have values higher than upper limits of P and S contents of an exemplary embodiment in the present disclosure, it can be seen that even when all the other conditions satisfy the conditions proposed in the present disclosure, brittleness occurred due to relatively high contents of P and S, and thus, a Kca value was 6000 or less at −10° C.

Meanwhile, in the case of Inventive Steels 1 to 6 satisfying the component range and the manufacturing range according to an exemplary embodiment in the present disclosure, it can be seen that ferrite and pearlite structures, a single phase structure of acicular ferrite, a complex structure of acicular ferrite and granular bainite, or a complex structure of acicular ferrite, pearlite and granular bainite may be included as a microstructure in the steel sheet, while satisfying a yield strength of 390 MPa or more and a grain size of 15 μm or less in a ¼t point.

In addition, it can be appreciated that an area ratio of a (100) plane forming an angle of less than 15 degrees with respect to a plane of a steel plate parallel to a rolling direction in a region from a surface layer portion of the steel plate to a ¼ point thereof in a thickness direction may be 30% or more, and a Kca value may satisfy a value of 6000 or more at −10° C.

FIG. 1 is an image obtained by capturing an image of a central portion of Inventive Steel 1 in a thickness direction using an optical microscope. It can be appreciated as illustrated in FIG. 1 that a structure of a central portion of a steel sheet in a thickness direction is relatively fine.

Embodiment 2

Steel sheets were manufactured under the same composition and manufacturing conditions as those of Inventive Steel 2 of Embodiment 1, except that weight ratios of Cu/Ni in steel slabs were changed as shown in Table 3, and surface properties of the manufactured steel sheets were examined. Results thereof are provided in the following Table 3.

In Table 3, the surface properties of the steel sheets were checked as to whether star cracks on surfaces occurred due to hot shortness.

TABLE 3

| | Steel Composition (Weight %) | | | | | | | | | | |
|---|---|---|---|---|---|---|---|---|---|---|---|
| Steel Grade | C | Si | Mn | Ni | Cu | Ti | Nb | P(ppm) | S(ppm) | Cu/Ni weight % | Surface Properties |
| Inventive Steel 7 | 0.069 | 0.22 | 1.26 | 0.42 | 0.22 | 0.017 | 0.016 | 72 | 12 | 0.52 | Non-occurrence |
| Inventive Steel 8 | | | | 0.38 | 0.19 | | | | | 0.50 | Non-occurrence |
| Inventive Steel 9 | | | | 0.56 | 0.27 | | | | | 0.48 | Non-occurrence |
| Inventive Steel 10 | | | | 0.63 | 0.31 | | | | | 0.49 | Non-occurrence |
| Comparative Steel 7 | | | | 0.32 | 0.27 | | | | | 0.84 | Occurrence |
| Comparative Steel 8 | | | | 0.22 | 0.21 | | | | | 0.95 | Occurrence |

As shown in Table 3, it can be appreciated that when a weight ratio of Cu/Ni is appropriately controlled, the surface properties of a steel sheet may be improved.

Embodiment 3

Steel sheets were manufactured under the same composition and manufacturing conditions as those of Inventive Steel 1 of Embodiment 1, except that grain sizes (μm) after rough rolling and before finish rolling were changed as shown in Table 4, and impact transition temperature characteristics of ¼t points of the manufactured steel sheets were investigated. The results thereof are provided in Table 4.

TABLE 4

| Steel Grade | Grain Size (μm) after Rough Rolling and Before Finish Rolling | ¼t Impact Transition Temperature (° C.) |
|---|---|---|
| Inventive Steel 11 | 76 | −65 |
| Inventive Steel 12 | 49 | −82 |
| Inventive Steel 13 | 68 | −78 |

TABLE 4-continued

| Steel Grade | Grain Size (μm) after Rough Rolling and Before Finish Rolling | ¼t Impact Transition Temperature (° C.) |
|---|---|---|
| Inventive Steel 14 | 65 | −79 |
| Inventive Steel 15 | 135 | −42 |
| Comparative Steel 10 | 182 | −37 |

As shown in Table 4, it can be seen that as the grain size of the ¼t point of the steel in a bar form after rough rolling is reduced, the impact transition temperature is decreased, and thus, it can be expected that brittle crack arrestability may be improved.

While exemplary embodiments have been shown and described above, it will be apparent to those skilled in the art that modifications and variations could be made without departing from the scope of the present invention as defined by the appended claims.

The invention claimed is:

1. A high-yield strength steel having excellent brittle crack arrestability, comprising:

0.05 wt % to 0.1 wt % of carbon (C), 0.9 wt % to 1.5 wt % of manganese (Mn), 0.8 wt % to 1.5 wt % of nickel (Ni), 0.005 wt % to 0.1 wt % of niobium (Nb), 0.005 wt % to 0.1 wt % of titanium (Ti), 0.1 wt % to 0.6 wt % of copper (Cu), 0.1 wt % to 0.4 wt % of silicon (Si), 100 ppm or less of phosphorus (P), 40 ppm or less of sulfur (S), and the remainder being iron (Fe) and other inevitably contained impurities, the high-yield strength steel having a microstructure including one structure selected from the group consisting of a single-phase structure of ferrite, a single-phase structure of bainite, a complex structure of ferrite and bainite, a complex structure of ferrite and pearlite, and a complex structure of ferrite, bainite and pearlite, and having a thickness of 50 mm or more, wherein, in a region from a surface layer portion to a ¼ thickness point in a thickness direction of the high-yield strength steel, an area ratio of a (100) plane forming an angle of less than 15 degrees with respect to a plane parallel to a rolling direction is 31% or more, and wherein the ferrite is acicular ferrite or polygonal ferrite, and the bainite is granular bainite.

2. The high-yield strength steel of claim 1, wherein the contents of Cu and Ni are set such that a weight ratio of Cu/Ni is 0.6 or less.

3. The high-yield strength steel of claim 1, wherein in the complex structure of ferrite and pearlite and the complex structure of ferrite, bainite and pearlite, a fraction of pearlite is 20 volume % or less.

4. The high-yield strength steel of claim 1, wherein in the region, a grain size of a crystal grain having a high angle boundary of 15 degrees or more when measured in an electron backscattered diffraction (EBSD) method is 15 μm or less.

5. The high-yield strength steel of claim 1, wherein the high-yield strength steel has a yield strength of 390 MPa or more.

6. The high-yield strength steel of claim 1, wherein the thickness is 80 mm to 100 mm.

* * * * *